US007455549B2

(12) United States Patent
Rodrigues et al.

(10) Patent No.: US 7,455,549 B2
(45) Date of Patent: Nov. 25, 2008

(54) COAXIAL CABLE CONNECTOR WITH FRICTION-FIT SLEEVE

(75) Inventors: Julio F. Rodrigues, Collierville, TN (US); Allen L. Malloy, Elmira, NY (US); Charles E. Thomas, Athens, PA (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 11/446,809

(22) Filed: Jun. 5, 2006

(65) Prior Publication Data

US 2007/0049113 A1 Mar. 1, 2007

Related U.S. Application Data

(60) Provisional application No. 60/764,450, filed on Feb. 2, 2006, provisional application No. 60/710,724, filed on Aug. 23, 2005.

(51) Int. Cl.
*H01R 9/05* (2006.01)

(52) U.S. Cl. ..... 439/578

(58) Field of Classification Search ..... 439/583–585, 439/394, 578

See application file for complete search history.

(56) References Cited

U.S. PATENT DOCUMENTS

| | | | |
|---|---|---|---|
| 1,667,485 | A | 4/1928 | MacDonald |
| 2,258,737 | A | 10/1941 | Browne |
| 2,544,654 | A | 3/1951 | Brown |
| 2,549,647 | A | 4/1951 | Turenne |
| 3,076,168 | A | 1/1963 | Keen |
| 3,184,706 | A | 5/1965 | Atkins |
| 3,275,913 | A | 9/1966 | Blanchard et al. |
| 3,292,136 | A | 12/1966 | Somerset |
| 3,350,677 | A | 10/1967 | Daum |
| 3,355,698 | A | 11/1967 | Keller |
| 3,373,243 | A | 3/1968 | Janowiak et al. |
| 3,406,373 | A | 10/1968 | Forney, Jr. |
| 3,448,430 | A | 6/1969 | Kelly |
| 3,475,545 | A | 10/1969 | Stark et al. |
| 3,498,647 | A | 3/1970 | Schroder |
| 3,517,373 | A | 6/1970 | Jamon |

(Continued)

FOREIGN PATENT DOCUMENTS

| | | |
|---|---|---|
| DE | 47931 | 10/1888 |

(Continued)

OTHER PUBLICATIONS

Sell Sheet from Stirling; www.StirlingUSA.com; Reader Service No. 109regarding SPL-6-RTQ 3-In-One RTQ Connectors.

(Continued)

*Primary Examiner*—Felix O. Figueroa
(74) *Attorney, Agent, or Firm*—Hoffman & Baron, LLP

(57) ABSTRACT

A coaxial cable connector includes an annular post defining an axial bore therein, a cylindrical connector body coupled to the post, a nut rotatably coupled to the post and a sleeve movably connected to the connector body. The sleeve includes at least one radially outwardly extending ridge formed on an outer surface thereof, which frictionally engages an inner surface of the connector body. As a result, the inner surface of the connector body does not require a recess or other engagement structure formed thereon.

16 Claims, 7 Drawing Sheets

U.S. PATENT DOCUMENTS

| | | | |
|---|---|---|---|
| 3,533,051 | A | 10/1970 | Ziegler, Jr. |
| 3,537,065 | A | 10/1970 | Winston |
| 3,544,705 | A | 12/1970 | Winston |
| 3,564,487 | A | 2/1971 | Upstone et al. |
| 3,629,792 | A | 12/1971 | Dorrell |
| 3,633,150 | A | 1/1972 | Swartz |
| 3,668,612 | A | 6/1972 | Nepovim |
| 3,671,922 | A | 6/1972 | Zerlin et al. |
| 3,694,792 | A | 9/1972 | Wallo |
| 3,710,005 | A | 1/1973 | French |
| 3,778,535 | A | 12/1973 | Forney, Jr. |
| 3,781,762 | A | 12/1973 | Quackenbush |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,879,102 | A | 4/1975 | Horak |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,963,320 | A | 6/1976 | Spinner |
| 3,976,352 | A | 8/1976 | Spinner |
| 3,980,805 | A | 9/1976 | Lipari |
| 3,985,418 | A | 10/1976 | Spinner |
| 4,046,451 | A | 9/1977 | Juds et al. |
| 4,053,200 | A | 10/1977 | Pugner |
| 4,059,330 | A | 11/1977 | Shirey |
| 4,093,335 | A | 6/1978 | Schwartz et al. |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,156,554 | A | 5/1979 | Aujla |
| 4,165,554 | A | 8/1979 | Faget |
| 4,168,921 | A | 9/1979 | Blanchard |
| 4,225,162 | A | 9/1980 | Dola |
| 4,227,765 | A | 10/1980 | Neumann et al. |
| 4,250,348 | A | 2/1981 | Kitagawa |
| 4,280,749 | A | 7/1981 | Hemmer |
| 4,339,166 | A | 7/1982 | Dayton |
| 4,346,958 | A | 8/1982 | Blanchard |
| 4,354,721 | A | 10/1982 | Luzzi |
| 4,373,767 | A | 2/1983 | Cairns |
| 4,400,050 | A | 8/1983 | Hayward et al. |
| 4,408,821 | A | 10/1983 | Forney, Jr. |
| 4,408,822 | A | 10/1983 | Nikitas |
| 4,421,377 | A | 12/1983 | Spinner |
| 4,444,453 | A | 4/1984 | Kirby et al. |
| 4,456,323 | A | 6/1984 | Pitcher et al. |
| 4,484,792 | A | 11/1984 | Tengler et al. |
| 4,515,427 | A | 5/1985 | Smit |
| 4,533,191 | A | 8/1985 | Blackwood |
| 4,540,231 | A | 9/1985 | Forney, Jr. |
| 4,545,637 | A | 10/1985 | Bosshard et al. |
| 4,575,274 | A | 3/1986 | Hayward et al. |
| 4,583,811 | A | 4/1986 | McMills |
| 4,593,964 | A | 6/1986 | Forney, Jr. et al. |
| 4,596,434 | A | 6/1986 | Saba et al. |
| 4,596,435 | A | 6/1986 | Bickford |
| 4,598,961 | A | 7/1986 | Cohen |
| 4,600,263 | A | 7/1986 | DeChamp et al. |
| 4,614,390 | A | 9/1986 | Baker |
| 4,632,487 | A | 12/1986 | Wargula |
| 4,640,572 | A | 2/1987 | Conlon |
| 4,645,281 | A | 2/1987 | Burger |
| 4,650,228 | A | 3/1987 | McMills et al. |
| 4,655,159 | A | 4/1987 | McMills |
| 4,660,921 | A | 4/1987 | Hauver |
| 4,666,229 | A | 5/1987 | Grand |
| 4,668,043 | A | 5/1987 | Saba et al. |
| 4,674,818 | A | 6/1987 | McMills et al. |
| 4,676,577 | A | 6/1987 | Szegda |
| 4,682,832 | A | 7/1987 | Punako et al. |
| 4,688,876 | A | 8/1987 | Morelli |
| 4,688,878 | A | 8/1987 | Cohen et al. |
| 4,691,976 | A | 9/1987 | Cowen |
| 4,703,987 | A | 11/1987 | Gallusser et al. |
| 4,717,355 | A | 1/1988 | Mattis |
| 4,738,009 | A | 4/1988 | Down et al. |
| 4,746,305 | A | 5/1988 | Nomura |
| 4,747,786 | A | 5/1988 | Hayashi et al. |
| 4,755,152 | A | 7/1988 | Elliot et al. |
| 4,761,146 | A | 8/1988 | Sohoel |
| 4,772,222 | A | 9/1988 | Laudig et al. |
| 4,789,355 | A | 12/1988 | Lee |
| 4,806,116 | A | 2/1989 | Ackerman |
| 4,813,886 | A | 3/1989 | Roos et al. |
| 4,834,675 | A | 5/1989 | Samchisen |
| 4,854,893 | A | 8/1989 | Morris |
| 4,857,014 | A | 8/1989 | Alf et al. |
| 4,869,679 | A | 9/1989 | Szegda |
| 4,874,331 | A | 10/1989 | Iverson |
| 4,892,275 | A | 1/1990 | Szegda |
| 4,902,246 | A | 2/1990 | Samchisen |
| 4,906,207 | A | 3/1990 | Banning et al. |
| 4,923,412 | A | 5/1990 | Morris |
| 4,925,403 | A | 5/1990 | Zorzy |
| 4,927,385 | A | 5/1990 | Cheng |
| 4,929,188 | A | 5/1990 | Lionetto et al. |
| 4,952,174 | A | 8/1990 | Sucht et al. |
| 4,957,456 | A | 9/1990 | Olson et al. |
| 4,973,265 | A | 11/1990 | Heeren |
| 4,979,911 | A | 12/1990 | Spencer |
| 4,990,104 | A | 2/1991 | Schieferly |
| 4,990,105 | A | 2/1991 | Karlovich |
| 4,990,106 | A | 2/1991 | Szegda |
| 5,002,503 | A | 3/1991 | Campbell et al. |
| 5,007,861 | A | 4/1991 | Stirling |
| 5,021,010 | A | 6/1991 | Wright |
| 5,024,606 | A | 6/1991 | Ming-Hwa |
| 5,037,328 | A | 8/1991 | Karlovich |
| 5,062,804 | A | 11/1991 | Jamet et al. |
| 5,066,248 | A | 11/1991 | Gaver, Jr. et al. |
| 5,073,129 | A | 12/1991 | Szegda |
| 5,083,943 | A | 1/1992 | Tarrant |
| 5,120,260 | A | 6/1992 | Jackson |
| 5,127,853 | A | 7/1992 | McMills et al. |
| 5,131,862 | A | 7/1992 | Gershfeld |
| 5,141,451 | A | 8/1992 | Down |
| 5,161,993 | A | 11/1992 | Leibfried, Jr. |
| 5,181,161 | A | 1/1993 | Hirose et al. |
| 5,195,906 | A | 3/1993 | Szegda |
| 5,205,761 | A | 4/1993 | Nilsson |
| 5,207,602 | A | 5/1993 | McMills et al. |
| 5,217,391 | A | 6/1993 | Fisher, Jr. |
| 5,217,393 | A | 6/1993 | Del Negro et al. |
| 5,269,701 | A | 12/1993 | Leibfried, Jr. |
| 5,283,853 | A | 2/1994 | Szegda |
| 5,284,449 | A | 2/1994 | Vaccaro |
| 5,295,864 | A | 3/1994 | Birch et al. |
| 5,316,494 | A | 5/1994 | Flanagan et al. |
| 5,338,225 | A | 8/1994 | Jacobsen et al. |
| 5,342,218 | A | 8/1994 | McMills et al. |
| 5,354,217 | A | 10/1994 | Gabel et al. |
| 5,371,819 | A | 12/1994 | Szegda |
| 5,371,821 | A | 12/1994 | Szegda |
| 5,371,827 | A | 12/1994 | Szegda |
| 5,393,244 | A | 2/1995 | Szegda |
| 5,431,583 | A | 7/1995 | Szegda |
| 5,435,745 | A | 7/1995 | Booth |
| 5,444,810 | A | 8/1995 | Szegda |
| 5,455,548 | A | 10/1995 | Grandchamp et al. |
| 5,456,611 | A | 10/1995 | Henry et al. |
| 5,456,614 | A | 10/1995 | Szegda |

| | | | | |
|---|---|---|---|---|
| 5,466,173 | A | 11/1995 | Down | |
| 5,470,257 | A | 11/1995 | Szegda | |
| 5,494,454 | A | 2/1996 | Johnsen | |
| 5,501,616 | A | 3/1996 | Holliday | |
| 5,525,076 | A | 6/1996 | Down | |
| 5,542,861 | A | 8/1996 | Anhalt et al. | |
| 5,548,088 | A | 8/1996 | Gray et al. | |
| 5,571,028 | A | 11/1996 | Szegda | |
| 5,586,910 | A | 12/1996 | Del Negro et al. | |
| 5,598,132 | A | 1/1997 | Stabile | |
| 5,607,325 | A | 3/1997 | Toma | |
| 5,620,339 | A | 4/1997 | Gray et al. | |
| 5,632,651 | A | 5/1997 | Szegda | |
| 5,651,699 | A | 7/1997 | Holliday | |
| 5,667,405 | A | 9/1997 | Holliday | |
| 5,863,220 | A | 1/1999 | Holliday | |
| 5,879,191 | A | 3/1999 | Burris | |
| 5,967,852 | A | 10/1999 | Follingstad et al. | |
| 5,975,951 | A | 11/1999 | Burris et al. | |
| 5,997,350 | A | 12/1999 | Burris et al. | |
| 6,032,358 | A | 3/2000 | Wild | |
| 6,089,912 | A * | 7/2000 | Tallis et al. | 439/584 |
| 6,089,913 | A | 7/2000 | Holliday | |
| 6,146,197 | A | 11/2000 | Holliday et al. | |
| 6,217,383 | B1 | 4/2001 | Holland | |
| 6,241,553 | B1 | 6/2001 | Hsia | |
| 6,261,126 | B1 | 7/2001 | Stirling | |
| D458,904 | S | 6/2002 | Montera | |
| D460,739 | S | 7/2002 | Fox | |
| D460,740 | S | 7/2002 | Montera | |
| D460,946 | S | 7/2002 | Montera | |
| D460,947 | S | 7/2002 | Montena | |
| D460,948 | S | 7/2002 | Montena | |
| 6,425,782 | B1 | 7/2002 | Holland | |
| D461,166 | S | 8/2002 | Montena | |
| D461,167 | S | 8/2002 | Montena | |
| D461,778 | S | 8/2002 | Fox | |
| D462,058 | S | 8/2002 | Montena | |
| D462,060 | S | 8/2002 | Fox | |
| D462,327 | S | 9/2002 | Montena | |
| D468,696 | S | 1/2003 | Montena | |
| 6,530,807 | B2 | 3/2003 | Rodrigues et al. | |
| 6,558,194 | B2 | 5/2003 | Montena | |
| 6,805,584 | B1 | 10/2004 | Chen | |
| 6,817,896 | B2 | 11/2004 | Deventhal | |
| 6,848,940 | B2 | 2/2005 | Montena | |
| 7,021,965 | B1 * | 4/2006 | Montena et al. | 439/578 |
| 7,118,416 | B2 * | 10/2006 | Montena et al. | 439/584 |
| 2002/0013088 | A1 | 1/2002 | Rodrigues et al. | |
| 2004/0102089 | A1 | 5/2004 | Chee | |
| 2006/0205272 | A1 | 9/2006 | Rodrigues et al. | |

FOREIGN PATENT DOCUMENTS

| | | |
|---|---|---|
| DE | 102289 | 7/1897 |
| DE | 1117687 | 11/1961 |
| DE | DT 1 515 398 | 11/1962 |
| DE | 1 191 880 | 4/1965 |
| DE | DT 2 221 936 | 5/1972 |
| DE | DT 2 225 764 | 5/1972 |
| DE | DT 2 261 973 | 12/1972 |
| DE | 32 11 008 A1 | 10/1983 |
| EP | 0 072 104 B1 | 2/1983 |
| EP | 0 116 157 A1 | 8/1984 |
| EP | 0 167 738 A2 | 1/1986 |
| EP | 0 265 276 B1 | 4/1988 |
| EP | 1 587 181 | 10/2005 |
| EP | 1 701 410 | 9/2006 |
| FR | 2 232 846 | 6/1973 |
| FR | 2 234 680 | 6/1974 |
| FR | 2 462 798 | 2/1981 |
| GB | 589697 | 3/1945 |
| GB | 1087228 | 10/1967 |
| GB | 1 270 846 | 4/1972 |
| GB | 2019 665 A | 10/1979 |
| GB | 2 079 549 A | 1/1982 |
| GB | 2079 549 A | 1/1982 |
| WO | 93/24973 | 12/1993 |
| WO | 96/08854 | 3/1996 |
| WO | WO 99/07035 | 2/1999 |
| WO | WO 01/86756 | 11/2001 |

OTHER PUBLICATIONS

Sell Sheet from PCT International; Reader Service No. 133; regarding DRS Compression Connectors—description/features and benefits.

* cited by examiner

COAXIAL CABLE CONNECTOR WITH FRICTION-FIT SLEEVE

CROSS-REFERENCE TO RELATED APPLICATIONS

This application claims the benefit of U.S. Provisional Application No. 60/710,724, filed on Aug. 23, 2005 and U.S. Provisional Application No. 60/764,450, filed on Feb. 2, 2006.

BACKGROUND OF THE INVENTION

The present invention relates generally to connectors for terminating coaxial cable. More particularly, the present invention relates to a coaxial cable connector providing an attachment method relying on frictional forces and enhanced cable locking methods to improve mechanical and electrical performance of the connector.

It has long been known to use connectors to terminate coaxial cable so as to connect a cable to various electronic devices such as televisions, radios and the like. Conventional coaxial cables typically include a center conductor surrounded by an insulator. A conductive foil is disposed over the insulator and a braided conductive shield surrounds the foil covered insulator. An outer insulative jacket surrounds the shield. In order to prepare the coaxial cable for termination, the outer jacket is stripped back exposing an extent of the braided conductive shield which is folded back over the jacket. A portion of the insulator covered by the conductive foil extends outwardly from the jacket and an extent of the center conductor extends outwardly from within the insulator. Such a prepared cable may be terminated in a conventional coaxial connector.

Prior art coaxial connectors generally include a connector body having an annular collar for accommodating a coaxial cable, an annular nut rotatably coupled to the collar for providing mechanical attachment of the connector to an external device and an annular post interposed between the collar and the nut. Upon assembly to a coaxial cable, the annular post is inserted between the foil covered insulator and the conductive shield of the cable. A resilient sealing O-ring may also be positioned between the collar and the nut at the rotatable juncture thereof to provide a water resistant seal thereat. The collar includes a cable receiving end for insertably receiving an inserted coaxial cable and, at the opposite end of the connector body, the nut includes an internally threaded end extent permitting screw threaded attachment of the body to an external device.

This type of coaxial connector further includes a locking sleeve to secure the cable to the connector body of the coaxial connector. The locking sleeve, which is typically formed of a resilient plastic, is securable to the connector body to secure the coaxial connector thereto. In this regard, the connector body typically includes some form of structure to cooperatively engage the locking sleeve. Such structure may include one or more recesses or detents formed on an inner annular surface of the connector body, which engages cooperating structure formed on an outer surface of the sleeve. A coaxial cable connector of this type is shown and described in commonly owned U.S. Pat. No. 6,530,807.

Such coaxial connectors are generally manufactured in large quantities at relatively low costs. Two cost factors in manufacturing these connectors are the complexity and the material of the individual connector components that are required for assembly. For example, it is desirable from a cost perspective to manufacture the connector components from plastic. However, molding complex structural features, such as engagement recesses and detents, into the internal diameter of the connector body are not practical, because such features hamper the opening of the mold. Methods to circumvent this mold limitation are also costly.

It is, therefore, desirable to provide a coaxial connector having improved cable gripping capabilities, while utilizing simply designed and easily manufactured components. In particular, it would be desirable to provide a coaxial connector with cable gripping features that prevent the cable from being easily pulled out of the connector.

OBJECTS AND SUMMARY OF THE INVENTION

It is an object of the present invention to provide a coaxial cable connector for terminating a coaxial cable.

It is a further object of the present invention to provide a coaxial cable connector having improved cable gripping capabilities, while utilizing simply designed and easily manufactured components.

In the efficient attainment of these and other objects, the present invention provides a coaxial cable connector. The connector of the present invention generally includes an annular post defining an axial bore therein, a cylindrical connector body coupled to the post, a nut rotatably coupled to the post and a sleeve movably connected to the connector body. The sleeve includes at least one radially outwardly extending ridge formed on an outer surface thereof, which frictionally engages an inner surface of the connector body. As a result, the inner surface of the connector body does not require a recess or other engagement structure formed thereon.

In a preferred embodiment, the sleeve and connector body are made of plastic and the sleeve includes a plurality of raised ridges formed thereon. Each ridge is further preferably defined by a rearwardly facing perpendicular wall and a forwardly facing chamfered wall.

The ridges may be divided into two axially spaced forward ridges and two axially spaced rearward ridges. The forward ridges have a first diameter and the rearward ridges have a second diameter that is slightly larger than the first diameter so that a greater holding force is provided by the interference-fit upon full insertion of the sleeve into the body. A rearwardmost locking ridge and an abutment surface may also be provided adjacent a flanged head portion of the sleeve to enhance locking of the sleeve into the connector body.

The forward end of the sleeve is further preferably formed with a plurality of flexible fingers extending in the forward direction for gripping a cable inserted into the connector. The fingers are forced to deflect radially inwardly by an internal ramp portion of the connector body during insertion of the sleeve into the body.

To further enhance gripping of the cable, the coaxial cable connector of the present invention preferably includes a connector body having a rearward sleeve receiving end, an annular post disposed within the connector body and an axially movable locking sleeve seated in the rearward sleeve receiving end of the connector body. The post has a radially outwardly projecting barb disposed at a rearward end thereof and the locking sleeve has an inwardly directed shoulder portion, which is positioned axially forward of the post barb when the sleeve is moved to a forward most locking position in the connector body.

An annular chamber is thus formed between the post barb and the inwardly directed shoulder portion of the sleeve. The annular chamber has a forward boundary defined by the sleeve shoulder portion and a rearward boundary defined by the post barb.

The post further preferably includes a second radially outwardly projecting barb disposed forward of the first barb. The shoulder portion of the sleeve is then axially positioned between the first and second post barbs when the sleeve is moved to the forward most locking position.

The post further preferably includes a flanged base portion disposed at a forward end thereof and a radially outwardly protruding connector body locking barb disposed between the forward base portion and the rearward end barb. The locking barb engages an inner surface of the connector body to secure the post to the body. In this regard, the connector body preferably includes a recess formed in its inner surface for lockingly receiving the post locking barb.

A preferred form of the coaxial connector, as well as other embodiments, objects, features and advantages of this invention, will be apparent from the following detailed description of illustrative embodiments thereof, which is to be read in conjunction with the accompanying drawings.

DETAILED DESCRIPTION OF THE PREFERRED EMBODIMENTS

The present invention is directed to connectors for terminating coaxial cable. Coaxial connectors of this type are shown and described in commonly owned U.S. Pat. No. 6,530,807 issued Aug. 28, 2003, the disclosure of which is incorporated herein by reference.

Figure 1:
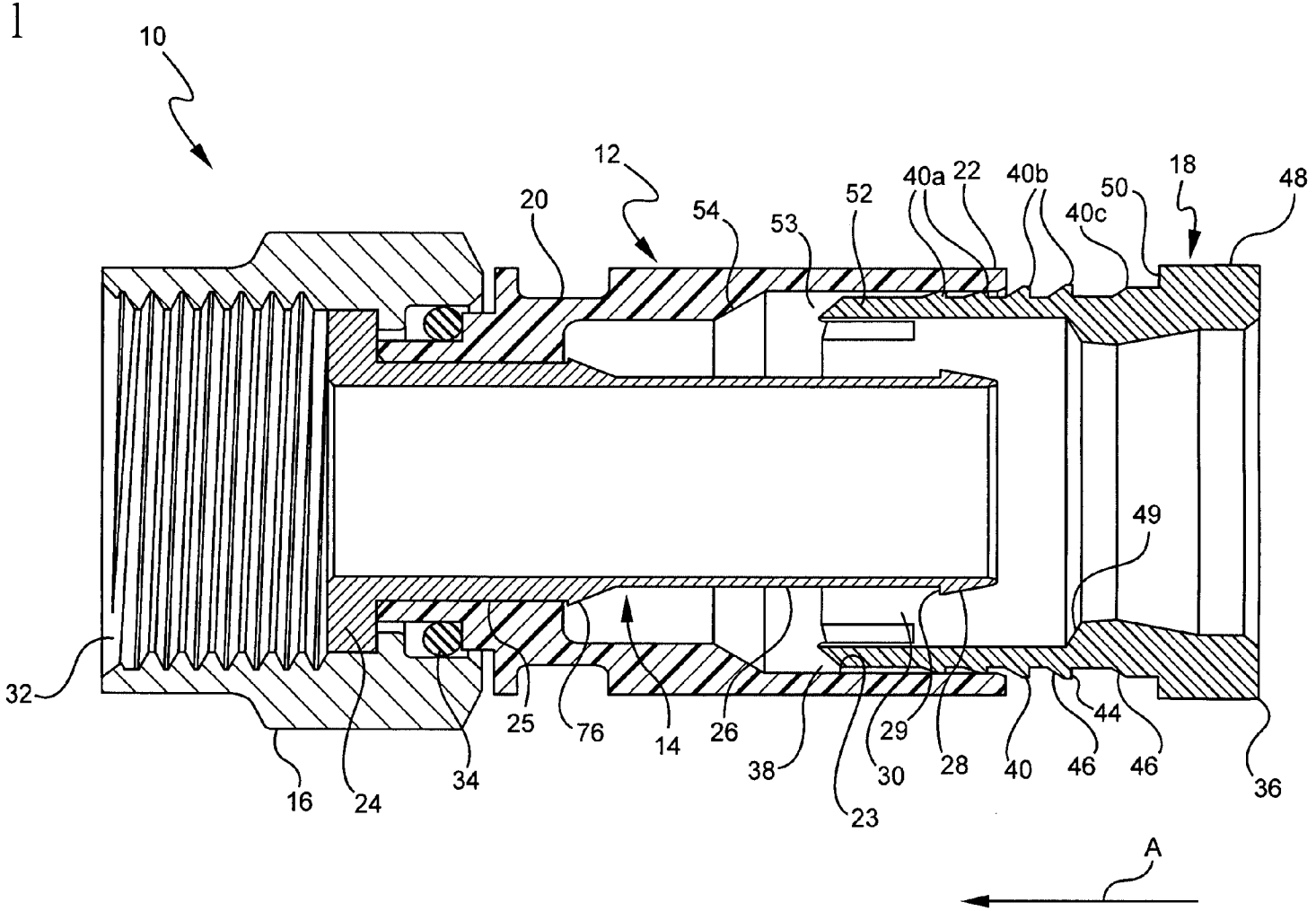
FIG. 1 is a cross-sectional view of the coaxial cable connector of the present invention in an open position.
Figure 2:
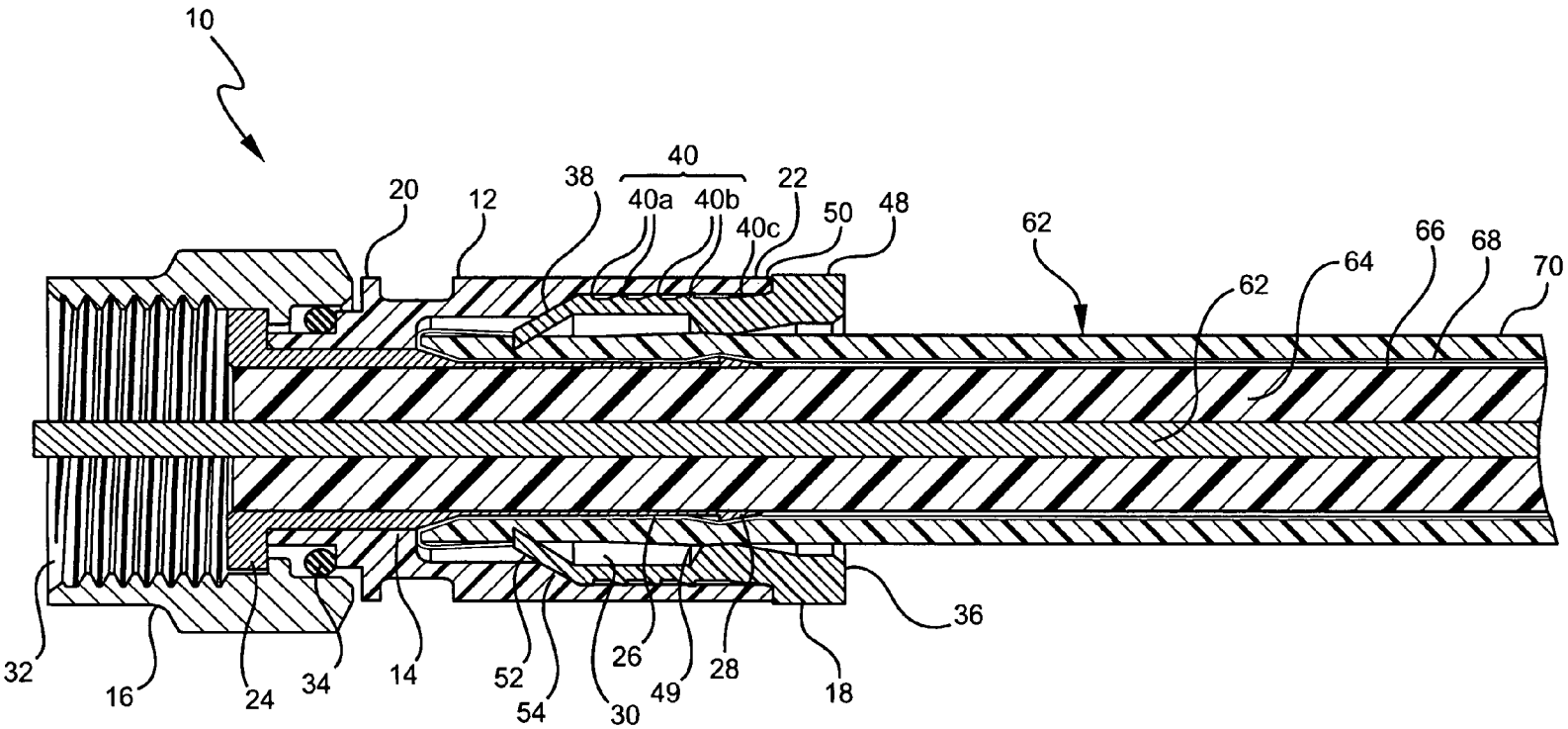
FIG. 2 is a cross-sectional view of the connector shown in FIG. 1 in a closed position with a cable secured thereto.

Referring to FIGS. 1 and 2, the coaxial cable connector 10 of the present invention is shown. The connector 10 generally includes four components: a connector body 12 (sometimes referred to as a "collar"); an annular post 14; a rotatable nut 16; and a movable locking sleeve 18. It is however conceivable that the connector body 12 and the post 14 can be integrated into one component and/or another fastening device other than the rotatable nut 16 can be utilized. Also, as will be discussed in further detail below, a resilient sealing O-ring 34 may be positioned between the body 12, the post 14 and the nut 16 at the rotatable juncture thereof to provide a water resistant seal thereat.

The connector body 12 is an elongate generally cylindrical member, which is preferably made from plastic to minimize cost. Alternatively, the body 12 may be made from metal or the like. The body 12 has one end 20 coupled to the post 14 and the nut 16 and an opposite sleeve receiving end 22 for insertably receiving the sleeve 18. The sleeve receiving end 23 defines an inner engagement surface 23 for frictionally engaging the sleeve 18, as will be described in further detail below.

The annular post 14 includes a flanged base portion 24, which is rotatably seated in a post receiving space in the nut 16, and a widened shoulder portion 25, which provides for press-fit securement of the post within the collar 12. The annular post 14 further includes an annular tubular extension 26 extending rearward within the body 12 and into the sleeve 18. The rearward end of the tubular extension 26 preferably includes a radially outwardly extending ramped flange portion or "barb" 28 having a forward facing edge 29 for compressing the outer jacket of the coaxial cable against the internal diameter of the body to secure the cable within the connector. Alternatively, and/or depending on the method of forming the post 14, the barb 28 may be more rounded as opposed to having a sharp edge 29. In any event, as will be described in further detail hereinbelow, the extension 26 of the post 14, the body 12 and the sleeve 18 define an annular chamber 30 for accommodating the jacket and shield of the inserted coaxial cable.

The nut 16 may be in any form, such as a hex nut, knurled nut, wing nut, or any other known attaching means, and is rotatably coupled to the post 14 for providing mechanical attachment of the connector 10 to an external device. The nut 16 includes an internally threaded end extent 32 permitting screw threaded attachment of the connector 10 to the external device. The sleeve 18 and the internally threaded end extension 32 define opposite ends of the connector 10. A resilient sealing O-ring 34 may be positioned between the body 12, the post 14 and the nut 16 at the rotatable juncture thereof to provide a water resistant seal thereat.

Figure 3B:
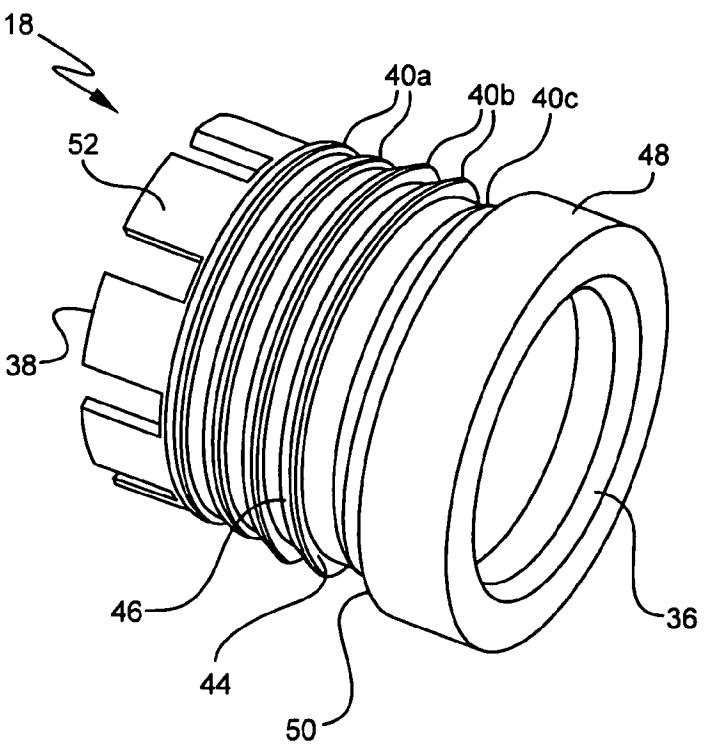
FIGS. 3A and 3B are perspective views of the sleeve component of the coaxial cable connector of the present invention.
Figure 3A:
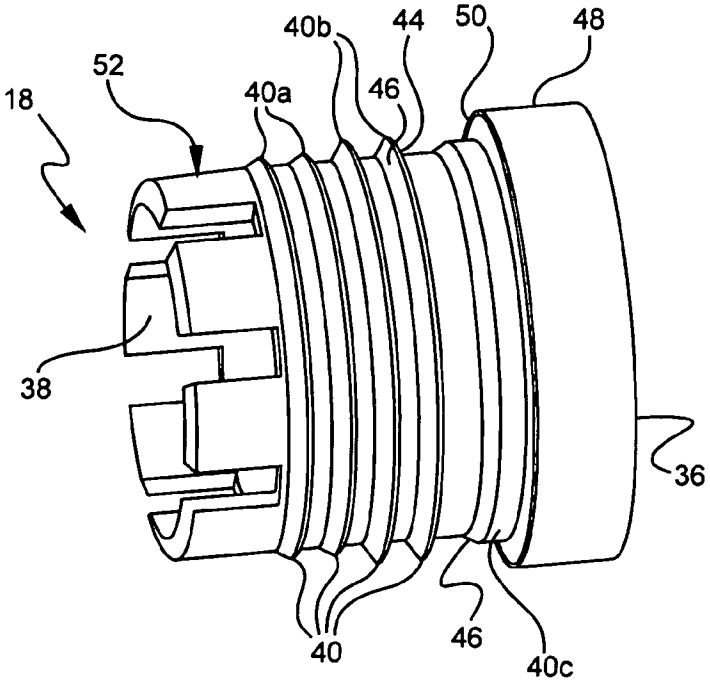
Figure 4:
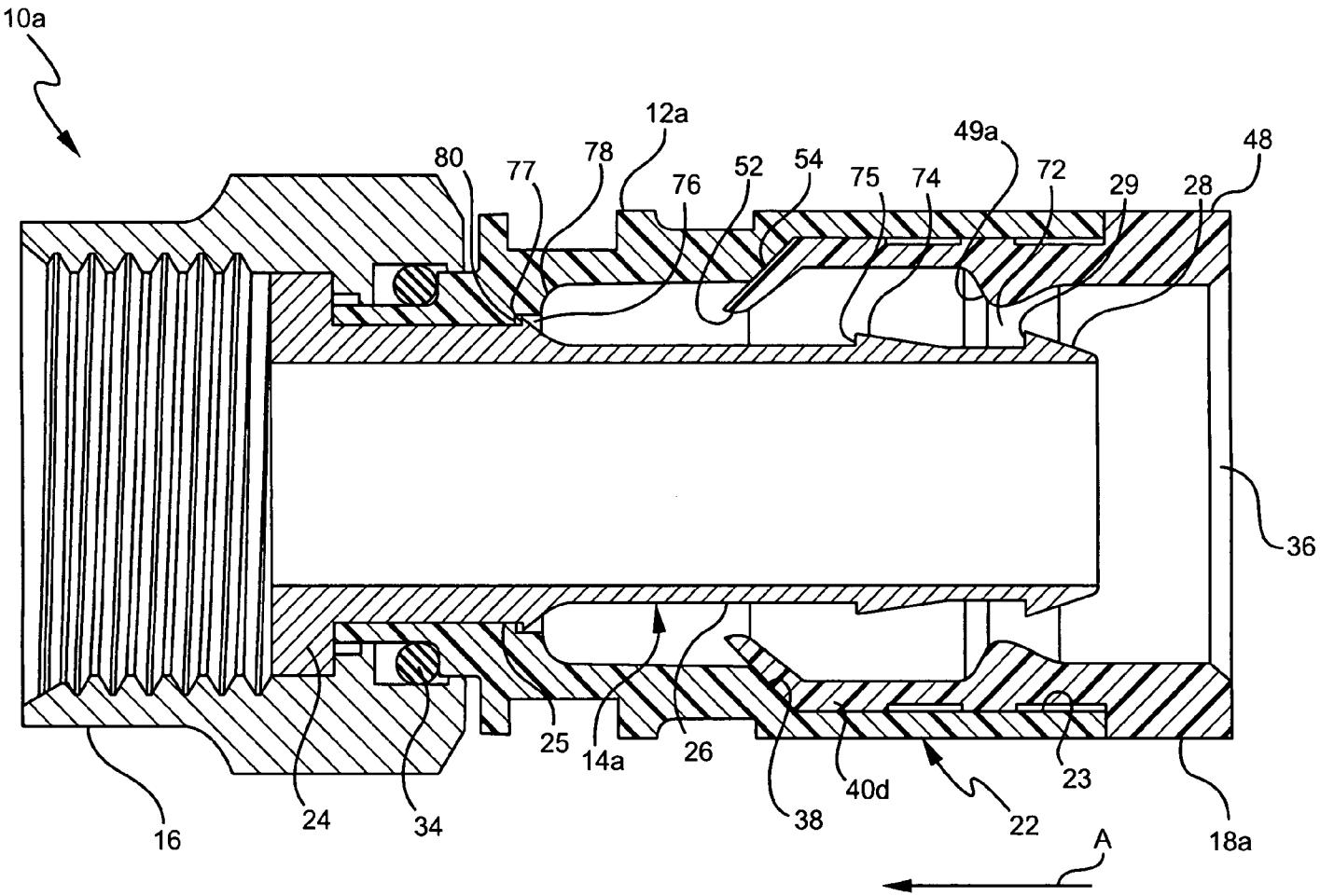
FIG. 4 is a cross-sectional view of a preferred embodiment of the coaxial cable connector of the present invention in a closed position.
Figure 5:
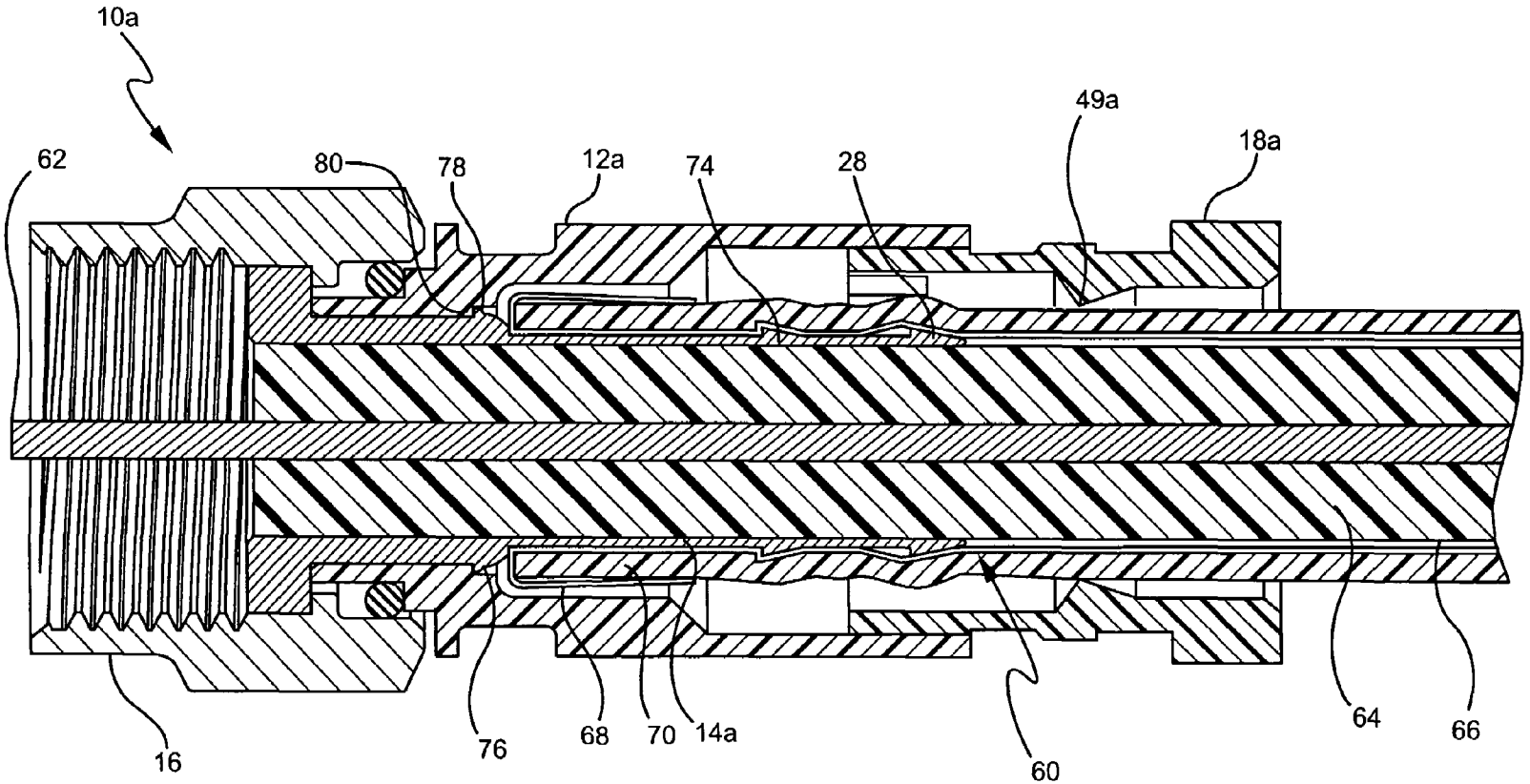
FIG. 5 is a cross-sectional view of the connector shown in FIG. 4 in an open position with a cable secured thereto.
Figure 6:
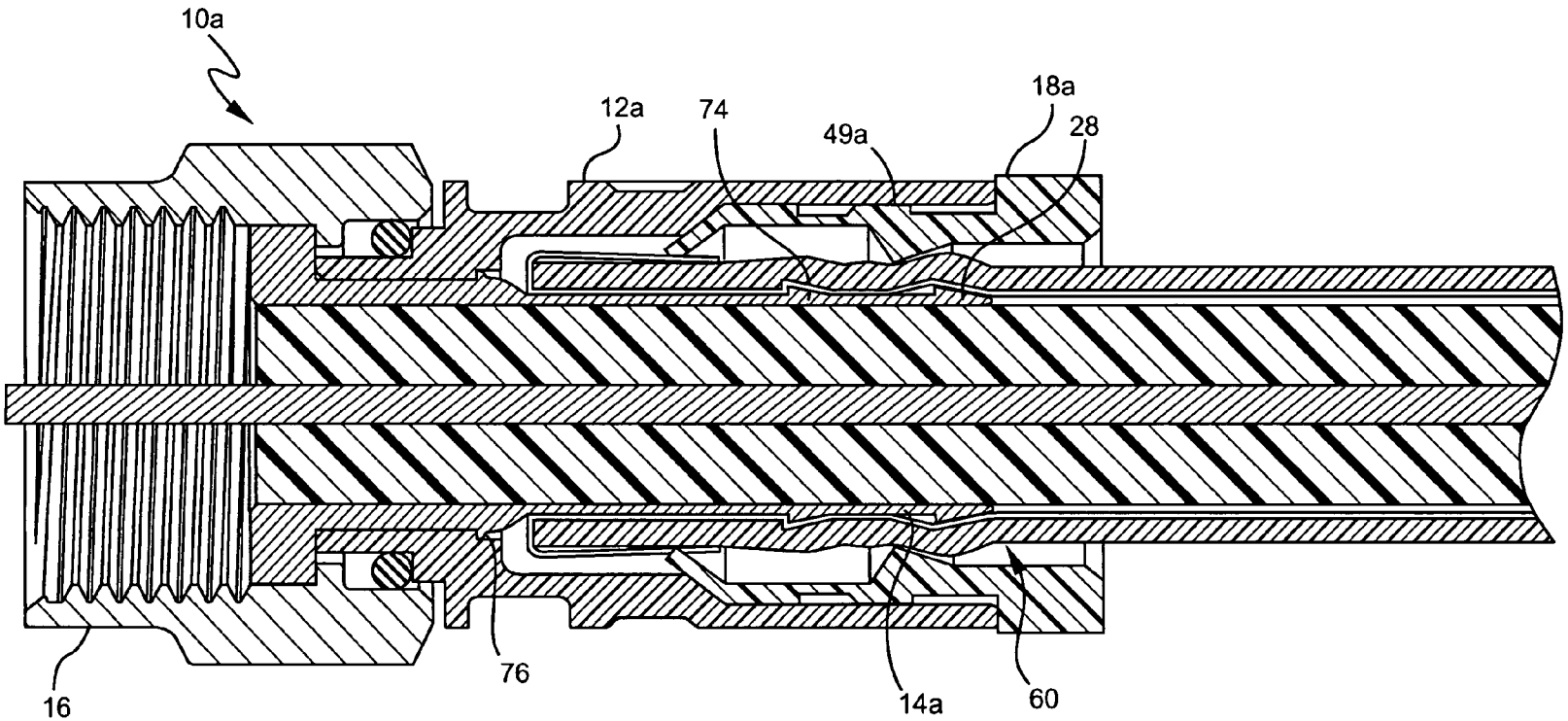
FIG. 6 is a cross-sectional view of the connector shown in FIG. 4 in a closed position with a cable secured thereto.
Figure 7:
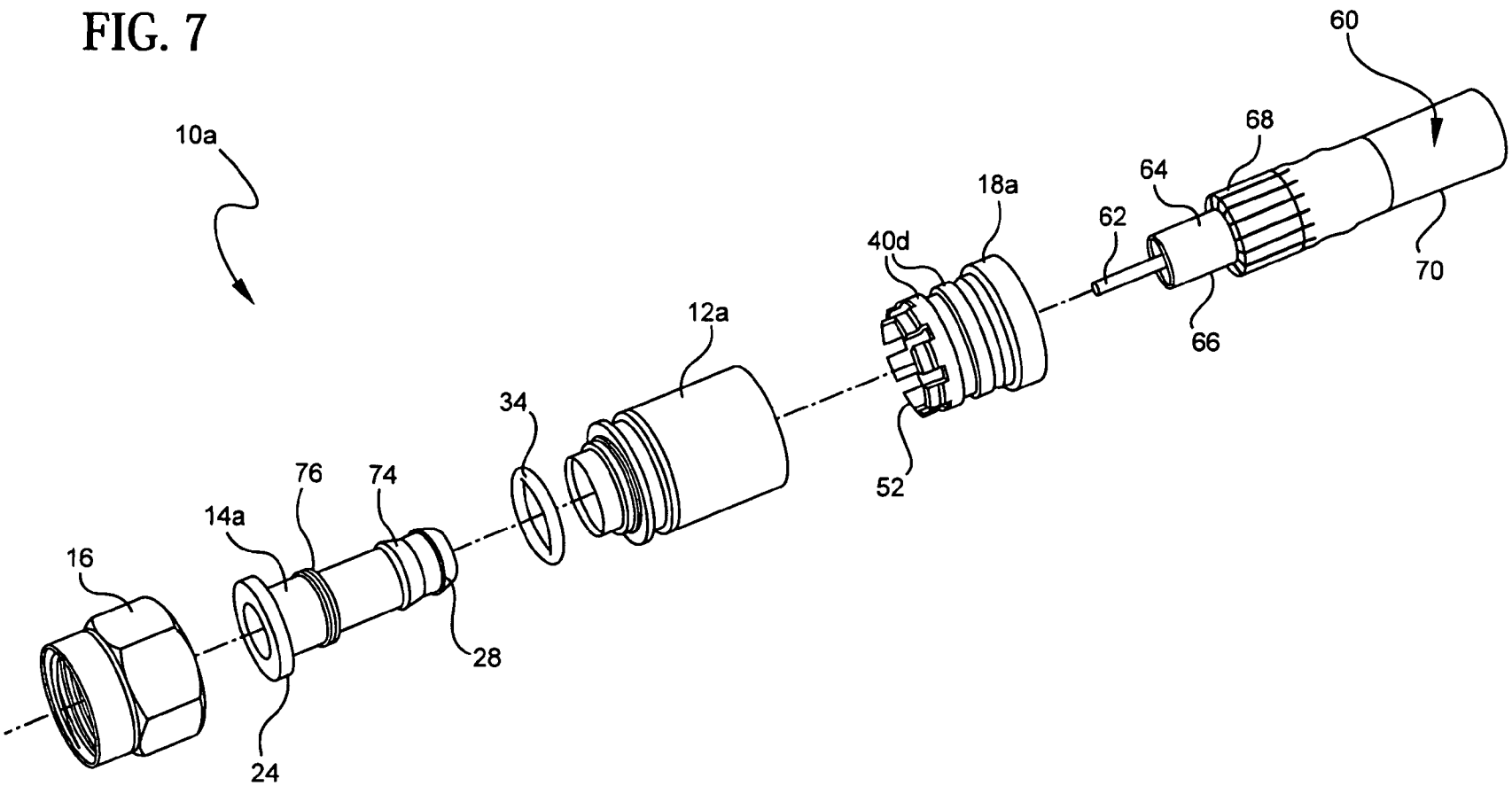
FIG. 7 is an exploded perspective view of the connector shown in FIG. 4.

Referring additionally to FIGS. 3A and 3B, the locking sleeve 18 is a generally tubular member having a rearward cable receiving end 36 and an opposite forward connector insertion end 38, which is movably coupled to the inner surface 23 of the connector body 12. As will be described in further detail hereinbelow, the outer cylindrical surface of the sleeve 18 includes a plurality of ridges or projections 40, which allows for the movable connection of the sleeve 18 to the connector body 12 such that the sleeve is axially moveable along arrow A of FIGS. 1 and 2, towards nut 16 from a first position shown in FIG. 1, which loosely retains a cable 60 within the connector 10, to a more forward second position shown in FIG. 2, which secures the cable within the connector.

Specifically, formed on the outer cylindrical surface of the sleeve 18, between the rearward cable receiving end 36 and the forward insertion end 38 is at least one radially outwardly extending ridge or projection 40. Preferably, there are a plurality of ridges 40 to increase the gripping force between the sleeve 18 and the inner surface 23 of the collar 12. Each ridge 40 is further preferably defined by a rearwardly facing perpendicular wall 44 and a forwardly facing chamfered wall 46. This structure facilitates forward insertion of the sleeve 18 into the body 12 in the direction of arrow A and resists rearward removal of the sleeve from the body.

In a preferred embodiment, the sleeve 18 includes two axially spaced forward ridges 40*a* having a first diameter and two axially spaced rearward ridges having a second diameter which is slightly larger than the first diameter. The first diameter of the forward ridges 40*a* is slightly larger than the inner diameter of the sleeve receiving end 22 of the body 12 so that an interference-fit is provided upon insertion of the sleeve 18 into the body in the first position, as shown in FIG. 1. The first diameter of the two forward ridges 40*a* that are inside and engaging the inner surface 23 of the body 12 in the first position causes an interference fit to hold the sleeve 18 in place during transportation and yet allows manual removal and reinsertion of the sleeve if necessary for installation. The second diameter of the two rearward ridges 40*b* is slightly larger than the first diameter of the forward ridges 40*a*. This helps prevent the sleeve from being inadvertently pushed inside the collar prematurely and provides an interference fit between the sleeve 18 and the body 12 with a greater holding force when the sleeve is in its closed position.

Moreover, the ridges or projections 40 of the present invention may take other forms. For example, while each ridge 40 is shown in the drawings to be continuous about the circumference of the locking sleeve 18, it is conceivable to provide gaps or spaces in one or more ridges to increase the ridge's flexibility. Also, it is possible to design one ridge in a manner which makes it more or less flexible than another ridge.

The locking sleeve 18 further preferably includes a flanged head portion 48 disposed at the rearward cable receiving end 36 thereof. The head portion 48 has an outer diameter larger than the inner diameter of the body 12 and includes a forward facing perpendicular wall 50, which serves as an abutment surface against which the rearward end of the body 12 stops to prevent further insertion of the sleeve 18 into the body 12. A rearward most locking ridge 40*c* having a forward facing chamfered wall 46 may also be provided adjacent the head portion 48 for providing additional gripping strength between the sleeve 18 and the body 12.

The forward end 38 of the sleeve 18 is further preferably formed with a plurality of flexible fingers 52 extending in the forward direction. As will be discussed in further detail below, these fingers 52 are forced to deflect radially inwardly by an internal ramp portion 54 of the connector body 12 during insertion of the sleeve 18 into the body. As the fingers 52 are deflected inward, they engage the outer jacket of the cable 60 to enhance the gripping of the cable within the connector 10. The fingers 52 may be formed simply by providing longitudinal slots or recesses at the forward end of the sleeve 18. A lateral groove (not shown) may also be provided to increase flexibility of the fingers 52.

Furthermore, the fingers 52 may include a tapered end 53 so as to form a relatively sharp edge. The sharp edge 53 would tend to bite into the cable 60 upon deflection of the fingers 52 by the internal ramp portion 54 of the connector body 12 to provide even greater gripping force and prevent the cable from being pulled out of the connector.

The connector 10 of the present invention is constructed so as to be supplied in the assembled condition shown in FIG. 1, wherein the forward ridges 40*a* of the sleeve 18 engage the inner surface of the body 12 to secure the sleeve in its first position. In such assembled condition, and as will be described in further detail hereinbelow, a coaxial cable 60 may be inserted through the rearward cable receiving end 36 of the sleeve 18. The sleeve 18 may then be moved from the first position loosely retaining the cable to the second position which is axially forward thereby locking the cable within the connector.

It is however contemplated that the sleeve 18 may be provided separately from the rest of the connector 10, which, in a manner which will be described in further detail hereinbelow, will allow the coaxial cable 60 to be first inserted directly into the post 14 unobstructed by the sleeve 18. Thereafter, the sleeve 18, which has been earlier placed around the cable 60, may be attached to the connector body 12 where it can be moved from the first position to the second position locking the cable within the connector.

Having described the components of the connector 10 in detail, the use of the connector in terminating a coaxial cable may now be described with respect to FIG. 2. Coaxial cable 60 includes an inner conductor 62 formed of copper or similar conductive material. Extending around the inner conductor 62 is an insulator 64 formed of a suitably insulative plastic. A metallic foil 66 is disposed over the insulator 64 and a metallic shield 68 is positioned in surrounding relationship around the foil covered insulator. Covering the metallic shield 68 is an outer insulative jacket 70.

Cable 60 is prepared in conventional fashion for termination by stripping back the jacket 70 exposing an extent of shield 68. A portion of the foil covered insulator 64 extends therefrom with an extent of conductor 62 extending from insulator 64. After an end extent of shield 68 is folded back about jacket 70, the cable 60 may be inserted into the connector 10 with the sleeve 18 already coupled to the body 12, as shown in FIG. 1. In this technique, the prepared cable 60 is inserted through the rearward end 36 of the sleeve 18 and the extension 26 of the post 14 is inserted between the foil covered insulator 64 and the metallic shield 68 such that the shield and the jacket 70 reside within the annular region 30 defined between the post 14 and the sleeve 18. When the sleeve 18 is coupled to the body 12 in the first position, as shown in FIG. 1, sufficient clearance is provided between the sleeve and the post 14 so that the tubular post extension 26 may be easily interposed between the insulator 64 and the shield 68 of the cable 60.

Once the cable 60 is properly inserted, the sleeve 18 may be moved axially forward in the direction of arrow A from the first position shown in FIG. 1, to the second position shown in FIG. 2. When the sleeve 18 is moved axially forward, the larger diameter rearward ridges 40*b* formed on the outer surface of the sleeve frictionally engage the inner surface of the body 12 to secure the sleeve within the body. Such movement is facilitated by the forward facing chamfered walls 46 of the ridges 40. The sleeve 18 is moved axially forward until the forward facing abutment surface 50 of the sleeve head portion 48 engages the rearward end of the body 12. A suitable compression tool may be used to effect movement of the sleeve 18 from its first position to its second position securing the cable 60 to the connector 10.

In certain installation settings, the installer may not have clear and convenient access when terminating the cable 60. Therefore, it may be difficult for the installer to blindly insert the cable 60 through the cable receiving end 36 of the sleeve 18 while connected to the connector body 12. In such situations, the present invention contemplates the ability to detachably remove the sleeve 18 from the body 12 so that the cable 60 may be directly connected to the tubular extension 26 of the post 14.

In these situations, the sleeve 18 is detachably removed from the body 12 in a manner facilitated as above described. The sleeve 18 is then slipped over the cable 60 and moved to a convenient position along the cable length. The end of the foil covered insulator 64 may then be inserted directly into the post extension 26 so that the extension is interposed between the foil covered insulator 64 and the shield 68. Thereafter, the sleeve 18 may be brought up along the cable 60 and the forward insertion end 38 of the sleeve may be inserted into the sleeve receiving end 22 of the body 12. Thereafter, as described above, the sleeve 18 may be moved from the first position shown in FIG. 1 to its second position shown in FIG. 2.

In either case, as the sleeve 18 moves to this second position, the jacket 70 and shield 68 of the cable 60 begins to become compressively clamped within the annular region 30 between the barb 28 of the post 14 and the inner surface of the sleeve 18. In this regard, the inner surface of the sleeve 18 is preferably provided with an inwardly directed shoulder portion 49 to facilitate compression of the cable jacket 70 against the barb 28 of the post 14. Also, as the sleeve 18 moves to its second position, the sleeve fingers 52 are urged inwardly by the ramp 54 formed in the connector body to further engage the cable jacket 70.

When the sleeve 18 is in its second, closed position, as shown in FIG. 2, all of the ridges 40 are frictionally engaged with the inner surface of the connector body 12 to prevent the sleeve from being easily removed from the assembly 10. Secondly, these ridges 40 provide redundant sealing points to prevent the ingress of water or other contaminants into the connector assembly 10. This feature eliminates the use of a separate o-ring and further reduces the manufacturing costs of the connector.

To further enhance locking of the cable 60, the connector 10*a* of the present invention is preferably provided with additional cable gripping features, as shown in FIGS. 4-7. In particular, the locking sleeve 18*a* of the connector 10*a* shown in FIGS. 4-7 includes an inwardly directed shoulder portion 49*a*, which has been moved forward as compared to that shown in FIGS. 1 and 2. More specifically, the inwardly directed shoulder portion 49*a* of the sleeve 18*a* shown in FIGS. 4-7 is positioned forward of the post barb 28 when the sleeve is in its closed position, instead of being aligned with the barb.

As a result, an annular chamber 72 is formed between the post barb and the inwardly directed shoulder portion 49*a* of the sleeve 18*a* for accommodating the jacket and shield of the inserted coaxial cable. This forward placement of the shoulder portion 49*a* with respect to the post barb 28 facilitates compressive clamping of the cable and prevents rearward movement of the cable. This arrangement also helps to lock the sleeve 18*a* in its forward closed position, thereby preventing the sleeve from creeping out of the collar 12*a*. Particularly, any rearward movement of the sleeve 18*a* will only cause the inwardly directed shoulder portion 49*a* to further compress the cable against the sharp edge 29 of the post barb 28 to halt further movement.

In the preferred embodiment, the post 14*a* further includes a second annular cable retention barb 74 disposed forward of the rearward end barb 28. When the locking sleeve 18*a* is in its closed position, the inwardly directed shoulder portion 49*a* of the sleeve thus falls between the end barb 28 and the second barb 74. Like the first barb 28, the second barb 74 is generally an annular, radially outwardly extending, ramped flange portion of the post 14*a* having a forward facing edge 75 for compressing the outer jacket of the coaxial cable to secure the cable within the connector 10*a*. The second barb 74 improves both the mechanical retention of the cable as well as the electromagnetic isolation or shielding of the signal inside the connector.

A third barb 76, which can be termed a connector body locking barb, is also preferably provided on the post 14*a* to help secure the post to the connector body 12*a*. The locking barb 76 is positioned on the post 14*a* between the rearward end barb 28 and the forward flanged base portion 24. Again, the locking barb 76 is generally an annular, radially outwardly extending ramped flange portion of the post 14*a* having a forward facing edge 77. In this case, however, the edge 77 of the locking barb 76 engages the connector body 12*a* to prevent any forward axial movement of the post 14*a* with respect to the connector body 12*a*. The connector body 12*a* preferably includes an annular recess 78 formed in its inner diametrical surface for receiving the locking barb 76. The recess 78 includes a rearward facing wall 80 for engaging the edge 77 of the barb 76 to prevent forward axial movement of the post 14*a* and to thereby lock the post to the collar 12*a*.

Such arrangement is desirable since the plastic material of the collar 12*a* and post 14*a* limits the strength of the interference fit therebetween. The third barb 76 is located just outside the press-fit area to assure adequate concentric alignment of the post 14*a* and collar 12*a*. The ramped portion of the barb 76 also facilitates easy rearward insertion of the post 14*a* into the collar 12*a*.

Also shown in FIGS. 4-7 is an alternative embodiment of the friction fit projections 40 provided on the sleeve 18*a*. In particular, the sleeve 18*a* shown in FIGS. 4-7 includes projections 40*d* which have been lengthened in the axial direction to increase the contact surface area between the projection and the inner engagement surface 23 of the connector body 12*a*. The increased contact surface area of the projections 40*d* also reduces stress on the plastic material by spreading the compression force over a wider area.

Thus, as a result of the present invention, a plastic connector body 12 can be utilized without the need for molding engagement structure into the inner surface of the body. Instead, the present invention provides an attachment method of the sleeve 18 to the body 12 that relies on frictional forces. Moreover, in the installed condition, the cable 60 is prevented from being easily pulled out of the connector by three points of pressure: a) the ridges 40 frictionally engaged against the inner surface of the body 12; b) the deflected fingers 52 exerting pressure on the cable caused by the inner slanted surface 54 of the body; and c) the cable jacket being compressed between the post barb 28 and the inner surface 49 of the sleeve 18.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

Various changes to the foregoing described and shown structures will now be evident to those skilled in the art. Accordingly, the particularly disclosed scope of the invention is set forth in the following claims.

What is claimed is:

1. A coaxial cable connector comprising:

a connector body having a rearward sleeve receiving end and an inner sleeve engagement surface; and an axially movable locking sleeve seated in said rearward sleeve receiving end of said connector body, said locking sleeve having first and second annular projections formed on an outer surface thereof for frictionally engaging said inner sleeve engagement surface of said connector body, said first annular projection having a first outer diameter and said second annular projection having a second outer diameter, said second outer diameter being greater than said first outer diameter whereby said second annular projection provides a stronger press-fit holding force in a radial direction against said inner sleeve engagement surface than said first annular projection.

2. A coaxial cable connector comprising:

a connector body having a rearward sleeve receiving end and an inner sleeve engagement surface;

an axially movable locking sleeve seated in said rearward sleeve receiving end of said connector body, said locking sleeve having a first and a second annular projections formed on an outer surface thereof for frictionally engaging said inner sleeve engagement surface of said connector body, said first annular projection having a first outer diameter and said second annular projection having a second outer diameter, said second outer diameter being greater than said first outer diameter whereby said second annular projection provides a stronger press-fit holding force in a radial direction against said inner sleeve engagement surface than said first annular projection; and an annular post disposed within said connector body, said post having a first radially outwardly projecting barb disposed at a rearward end thereof and a second radially outwardly projecting barb disposed forward of said first barb, wherein said post further includes a flanged base portion disposed at a forward end thereof and a radially outwardly protruding connector body locking barb disposed between said forward base portion and said rearward end barb, said locking barb engaging an inner surface of said connector body to secure said post to said body.

3. A coaxial cable connector as defined in claim 2 wherein said connector body includes a recess formed in said inner surface for lockingly receiving said locking barb.

4. A coaxial cable connector as defined in claim 2, wherein said connector body is made from a plastic material.

5. A coaxial cable connector as defined in claim 2, further comprising a nut rotatably coupled to said post.

6. A coaxial cable connector as defined in claim 2, wherein said sleeve is made from a plastic material.

7. A coaxial cable connector as defined in claim 2, wherein said locking sleeve further comprises a rearward cable receiving end and an opposite forward connector insertion end, said forward connector insertion end being formed with at least one flexible finger for gripping a cable inserted in said sleeve.

8. A coaxial cable connector as defined in claim 2, wherein said first barb of said annular post is formed with a forward facing edge and said locking sleeve further includes an inwardly directed shoulder portion, said shoulder portion having a rearward facing wall being positioned axially forward of said forward facing edge of said first post barb when said sleeve is moved to a forward most locking position in said connector body, thereby forming an annular chamber bounded by said rearward facing wall of said shoulder portion and said forward facing edge of said first post barb for receiving a jacket of a cable inserted in said cable connector, wherein rearward movement of said locking sleeve compresses the cable jacket against said forward facing edge of said first post barb.

9. A coaxial cable connector as defined in claim 8, wherein said shoulder portion of said sleeve is axially positioned between said first and second post barbs when said sleeve is moved to said forward most locking position.

10. A coaxial cable connector comprising:

a connector body having a rearward sleeve receiving end and an inner sleeve engagement surface;

an axially movable locking sleeve seated in said rearward sleeve receiving end of said connector body, said locking sleeve having a first and a second annular projections formed on an outer surface thereof for frictionally engaging said inner sleeve engagement surface of said connector body, said first annular projection having a first outer diameter and said second annular projection having a second outer diameter, said second outer diameter being greater than said first outer diameter whereby said second annular projection provides a stronger press-fit holding force in a radial direction against said inner sleeve engagement surface than said first annular projection; and an annular post disposed within said connector body, said post having a radially outwardly projecting barb disposed at a rearward end thereof, a flanged base portion disposed at a forward end thereof and a radially outwardly protruding connector body locking barb disposed between said forward base portion and said rearward end barb, said locking barb engaging an inner surface of said connector body to secure said post to said body, wherein said connector body includes a recess formed in said inner surface for lockingly receiving said locking barb.

11. A coaxial cable connector as defined in claim 10, wherein said connector body is made from a plastic material.

12. A coaxial cable connector as defined in claim 10, further comprising a nut rotatably coupled to said post.

13. A coaxial cable connector as defined in claim 10, wherein said sleeve is made from a plastic material.

14. A coaxial cable connector as defined in claim 10, wherein said locking sleeve further comprises a rearward cable receiving end and an opposite forward connector insertion end, said forward connector insertion end being formed with at least one flexible finger for gripping a cable inserted in said sleeve.

15. A coaxial cable connector as defined in claim 10, wherein said first barb of said annular post is formed with a forward facing edge and said locking sleeve further includes an inwardly directed shoulder portion, said shoulder portion having a rearward facing wall being positioned axially forward of said forward facing edge of said first post barb when said sleeve is moved to a forward most locking position in said connector body, thereby forming an annular chamber bounded by said rearward facing wall of said shoulder portion and said forward facing edge of said first post barb for receiving a jacket of a cable inserted in said cable connector, wherein rearward movement of said locking sleeve compresses the cable jacket against said forward facing edge of said first post barb.

16. A coaxial cable connector as defined in claim 15, wherein said post further includes a second radially outwardly projecting barb disposed forward of said first barb, said shoulder portion of said sleeve being axially positioned between said first and second post barbs when said sleeve is moved to said forward most locking position.

* * * * *

UNITED STATES PATENT AND TRADEMARK OFFICE

CERTIFICATE OF CORRECTION

PATENT NO. : 7,455,549 B2
APPLICATION NO. : 11/446809
DATED : November 25, 2008
INVENTOR(S) : Rodrigues et al.

It is certified that error appears in the above-identified patent and that said Letters Patent is hereby corrected as shown below:

ON THE TITLE PAGE, item [74]:

Now reads: "Hoffman & Baron, LLP"

Should read: --Hoffmann & Baron, LLP--

Column 8, line 65:

Now reads: "having a first and a second annular projections"

Should read: --having first and second annular projections--

Column 10, line 1:

Now reads: "having a first and a second annular projections"

Should read: --having first and second annular projections--

Signed and Sealed this

Twenty-sixth Day of May, 2009

John Doll

JOHN DOLL
*Acting Director of the United States Patent and Trademark Office*